US006254089B1

(12) United States Patent
Becker et al.

(10) Patent No.: US 6,254,089 B1
(45) Date of Patent: Jul. 3, 2001

(54) SUCTION GRIPPER FOR TRANSFERRING THE TRAILING EDGE OF A SHEET IN A TURNING DEVICE OF A SHEET-FED ROTARY PRINTING MACHINE

(75) Inventors: Willi Becker, Bammental; Andreas Fricke, Eberbach, both of (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 0 days.

(21) Appl. No.: 09/244,246

(22) Filed: Feb. 3, 1999

(30) Foreign Application Priority Data

Feb. 3, 1998 (DE) ..... 198 04 039

(51) Int. Cl.[7] ..... B41F 21/06; B65H 5/14; B65H 5/12

(52) U.S. Cl. ..... 271/276; 101/410

(58) Field of Search ..... 271/276, 275, 271/277; 101/222, 223, 230, 257, 410, 409, 411

(56) References Cited

U.S. PATENT DOCUMENTS 2,726,865 * 12/1955 Backhouse ..... 271/231
4,343,241 * 8/1982 Rudolph et al. ..... 271/276
4,790,244 * 12/1988 Otfried et al. ..... 271/276
5,454,312 * 10/1995 Helmstaedter et al. ..... 271/276
5,489,093 * 2/1996 Morehead ..... 101/409

FOREIGN PATENT DOCUMENTS 142 953 7/1980 (DE) .
38 29 626 A1 3/1990 (DE) .
196 17 493 A1 11/1997 (DE) .
2 048 833 12/1980 (GB) .

* cited by examiner

*Primary Examiner*—John M. Jillions
(74) *Attorney, Agent, or Firm*—Herbert L. Lerner; Laurence A. Greenberg; Werner H. Stemer

(57) ABSTRACT

A suction gripper for transferring a trailing edge of a sheet guided on an upstream sheet-conveying cylinder to a downstream sheet-conveying cylinder of a turning device of a sheet-fed rotary printing machine includes a holding arm. The holding arm can be extended out of the circumferential surface of the downstream sheet-conveying cylinder, to which a suction head is movably fastened. The suction head is connected to the holding arm via a spring and its movement in a direction toward a circumferential surface of the upstream sheet conveying cylinder is limited by a stop.

24 Claims, 6 Drawing Sheets

20
18
6
46
22
16a
40
38
42
10
28
36
14
24

32
34
18
6
46
30
22
16b
40
38
44
42
10
28
36
14
26
24

206
260
220
232
218
218a
16a
10
236
14
224

SUCTION GRIPPER FOR TRANSFERRING THE TRAILING EDGE OF A SHEET IN A TURNING DEVICE OF A SHEET-FED ROTARY PRINTING MACHINE

BACKGROUND OF THE INVENTION

1. Field of the Invention

The invention relates to a suction gripper for transferring the trailing edge of a sheet in a turning device of a sheet-fed rotary printing machine.

Published, Non-Prosecuted German Patent Application DE 38 29 626 A discloses a sheet-fed rotary printing machine having a turning device in which, during perfecting operation, a suction gripper is pivoted out of a periphery of a cylinder disposed downstream of a back-pressure cylinder toward the circumferential surface of the back-pressure cylinder. There, it grips the trailing edge of the sheet to be turned and, before passing the gripper center line in between the two cylinders, guides the trailing edge into the periphery of the downstream cylinder. Because of the rigid and stiff configuration of the suction gripper and of the fixedly predefined pivoting path, during the processing of printed materials of different thicknesses, the result is sharply varying pressure forces with which the suction head of the suction gripper is pressed against the paper and, respectively, the circumferential surface of the back-pressure cylinder when picking up the sheet trailing edge by suction. Thus, in the case of very thin papers, such as bible paper, there is the risk that the suction head of the suction gripper will not touch the surface of the sheet at all. This can result in relatively large fluctuations in the location of the trailing edge of the sheet in relation to the suction gripper, and lead to register errors when transferring the sheet trailing edge to subsequent gripper devices. However, during the processing of thick printed materials, high mechanical forces are exerted on the trailing edge of the sheet, on the suction gripper as such and on the gear mechanism actuating the suction gripper. As a result of which pressure points may form on the sheet and the suction gripper or the gear mechanism is subjected to high mechanical stress and hence to high wear.

Published, Non-Prosecuted German Patent Application DE 41 06 703 A1 discloses a swinging sucker system, which can be pivoted about a first rocker shaft and, in perfecting operation, grips the trailing edge of a sheet to be transferred in the region of a gripper center line between upstream and downstream sheet-conveying cylinders. In order to adapt to different printed material thicknesses, the swinging sucker system is mounted on a rocker, which can be pivoted by an eccentric about a second rocker shaft. In order to limit the maximum adjustment travel of the eccentric and hence the maximum printed material thickness to be printed, the rocker is provided with a stop. The stop, in the case of maximum sheet thicknesses to be processed, rests on an associated stop on the cylinder body of the downstream sheet-conveying cylinder. Also disposed between the rocker and the cylinder body is a compression spring which, in order to produce a counterforce when the eccentric is rotated in the direction of the maximum printed material thickness, exerts a counterforce on the rocker. Apart from the fact that the device described is mechanically complicated to produce and contains numerous moving parts, it does not permit any automatic adaptation to different printed material thicknesses.

German Democratic Republic Patent No. 142 953 discloses a sucker in a turning device of a sheet-fed rotary printing machine, which has a suction head which is produced from flexible material and automatically adapts to printed materials of different thicknesses. Because of the flexible configuration of the suction head, in the event of the sheet being tautened before the transfer to a downstream gripper device, positional displacements of the sheet occur, which rule out the in-register transfer of the sheet trailing edge. Furthermore, the suction head made of flexible material that is described in the document has the disadvantage that its elastic properties can change sharply over the course of time and that, in the case of processing very thick sheets, for example those with a thickness in the region of 1 mm, very high forces nevertheless act on the sucker as such. These forces being brought about by the fact that it is not just the thin-walled lip of the sucker but the entire rubber body of the same that is compressed. This contradicts the requirement to configure the rubber lip to be as thin-walled as possible in the case of processing very thin sheets, in order to rule out the local sucking in and tearing of the paper in the region of the suction heads. The flexible suction heads described therefore constitute only a compromise.

SUMMARY OF THE INVENTION

It is accordingly an object of the invention to provide a suction gripper for transferring the trailing edge of a sheet in a turning device of a sheet-fed rotary printing machine which overcomes the above-mentioned disadvantages of the prior art devices of this general type.

With the foregoing and other objects in view there is provided, in accordance with the invention, in combination with a sheet-fed rotary printing machine having an upstream sheet-conveying cylinder and a turning device, a suction gripper for transferring a trailing edge of a sheet guided on the upstream sheet-conveying cylinder to the turning device having a downstream sheet-conveying cylinder with a circumferential surface, the suction gripper including: a holding arm to be extended out of the circumferential surface of the downstream sheet-conveying cylinder; a spring; and a suction head movably connected to the holding arm via the spring.

The invention achieves the object of providing a suction gripper for transferring the trailing edge of a sheet to be turned in a turning device of a sheet-fed rotary printing machine which permits automatic adaptation to the widest possible range of printed material thicknesses. In addition, the invention ensures extremely precise transfer of the sheet trailing edge to downstream gripper devices. Furthermore, it is an object of the present invention to provide a suction gripper which has a comparatively low weight, which has only a comparatively small number of mechanically moving parts and which needs virtually no maintenance and adjustment work.

In accordance with an added feature of the invention, there is a stop for limiting a movement of the suction head in a direction of a circumferential surface of the upstream sheet-conveying cylinder.

In accordance with an additional feature of the invention, the spring is a leaf spring having a first end connected to the holding arm and a second end connected to the suction head.

In accordance with another feature of the invention, the leaf spring has a threaded hole formed therein close to the suction head, and the stop is supported on the holding arm and has an adjusting screw to be screwed into the threaded hole of the leaf spring.

In accordance with a further added invention, the holding arm has a guide formed thereon, the suction head is accommodated in the guide and the guide permits a movement of the suction head in a direction running substantially perpendicular to the holding arm.

In accordance with a further additional feature of the invention, the spring is at least one compression spring accommodated in the guide and has a first end supported on the holding arm and a second end supported on the suction head.

In accordance with another added feature of the invention, the holding arm has an opening formed therein, the stop has a nut and a pin element with a threaded section springing out of the suction head and the threaded section extending through the opening formed in the holding arm, and the nut element is screwed onto the threaded section.

In accordance with an added feature of the invention, the holding arm has a greater stiffness in a sheet transport direction than in a direction towards a circumferential surface of the upstream sheet-conveying cylinder.

In accordance with an additional feature of the invention, the holding arm has a greater stiffness in a direction transverse to a sheet transport direction than in a direction towards a circumferential surface of the upstream sheet-conveying cylinder.

In accordance with another feature of the invention, the holding arm includes a flexible tube.

In accordance with a further added feature of the invention, the stop is formed on the gripper shaft and the stop is adjustable.

In accordance with a further additional feature of the invention, the suction head has a suction face with a large number of groove-like depressions formed therein for picking up the sheets and fluidically communicating with the central suction-air channel.

In accordance with a concomitant feature of the invention, the suction head is selected from the group consisting of cylindrical shaped suctions heads and rectangular shaped suction heads.

Other features which are considered as characteristic for the invention are set forth in the appended claims.

Although the invention is illustrated and described herein as embodied in a suction gripper for transferring the trailing edge of a sheet in a turning device of a sheet-fed rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
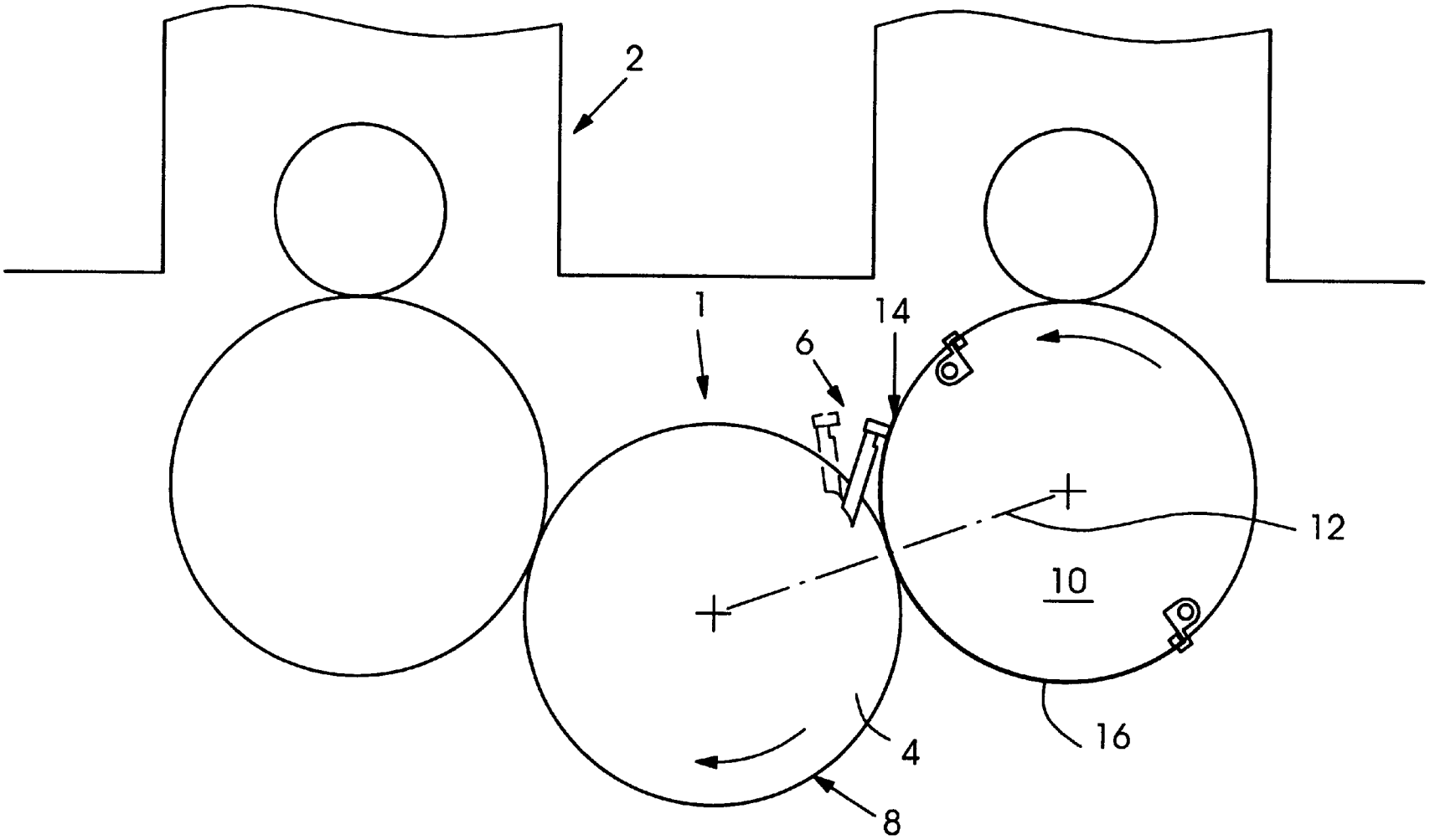
FIG. 1 is a diagrammatic illustration of a sheet-fed rotary printing machine having a turning device, and a suction gripper disposed on a turning drum of the turning device according to the invention.

In all the figures of the drawing, sub-features and integral parts that correspond to one another bear the same reference symbol in each case. Referring now to the figures of the drawing in detail and first, particularly, to FIG. 1 thereof, there is shown a turning device 1 of a sheet-fed rotary printing machine 2 including a turning cylinder or drum 4, on which there is disposed an inventive suction gripper 6. The suction gripper 6 can be pivoted out of a periphery 8 of the turning drum 4, preferably in a region upstream of a transfer center line 12 between a back-pressure cylinder 10 of an upstream printing unit and the turning drum 4, in order to grip a trailing edge 14 of a sheet 16 to be turned. Although the suction gripper 6 is described below using the example of the turning device 1, which operates in accordance with the principle of the so-called single-drum turning, its use is not restricted to such a turning device and can be provided, for example, also on a known turning device having a storage drum.

Figure 2:
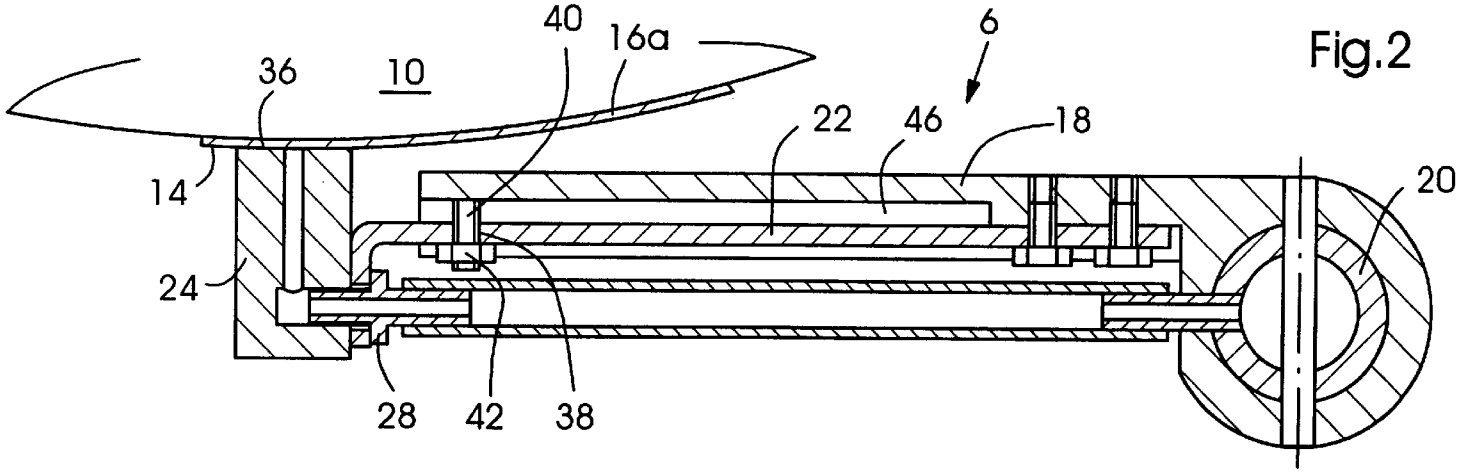
FIG. 2 is a sectional view of a first embodiment of the suction gripper when gripping a trailing edge of a thin sheet guided on an upstream sheet-conveying cylinder.
Figure 3:
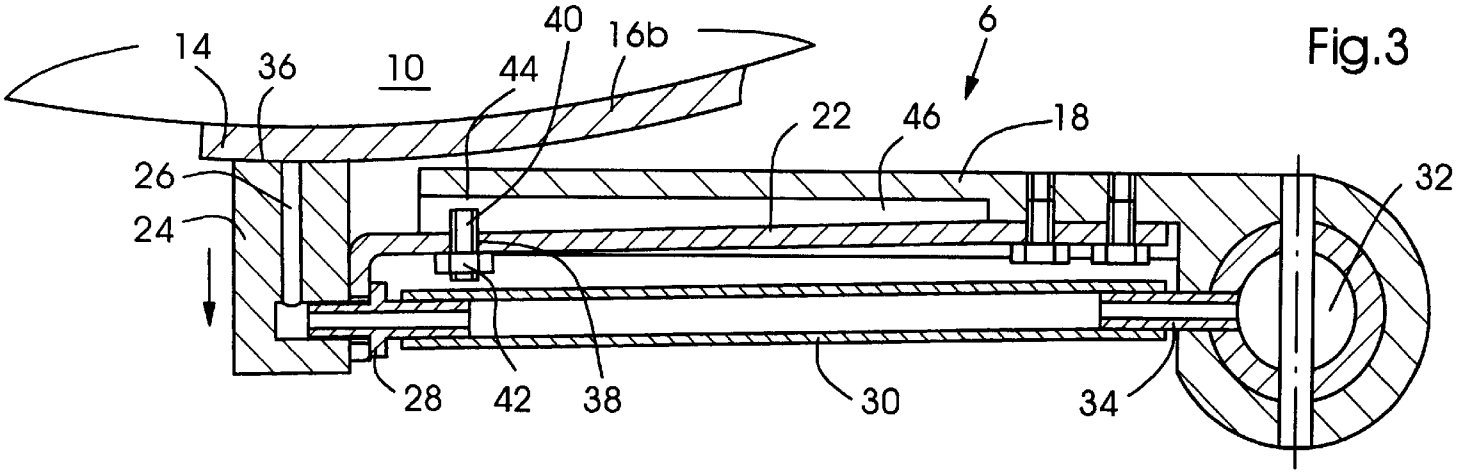
FIG. 3 is a sectional view of the suction gripper of FIG. 2 when gripping a thick sheet guided on the upstream sheet-conveying cylinder.

According to a first, preferred embodiment of the suction gripper 6, which is illustrated in FIGS. 2 and 3, the suction gripper 6 includes a holding arm 18. The holding arm 18 is rotationally fixedly connected to a gripper shaft 20, by which the gripper 6 is pivoted out of the periphery 8 of a downstream sheet-conveying cylinder, for example of the turning drum 4 of FIG. 1. A leaf spring 22 is fastened at one end to the holding arm 18 of the suction gripper 6, preferably close to the gripper shaft 20. The other end of the leaf spring 22 is connected to a suction head 24, which is preferably produced from a lightweight material, such as light metal or plastic. The suction head 24 has in its interior a suction-air bore 26, which has suction air applied to it via a nozzle 28 and a preferably flexible connecting line 30.

In the case of the preferred embodiment of the invention, the suction air is supplied via a bore 32 that is formed in the gripper shaft 20 and has a flow connection to the flexible connecting line 30 via a further nozzle 34. The suction-air bore 26 preferably extends directly as far as a suction face 36 of the suction head 24, the latter preferably being provided with a large number of groove-like depressions (not illustrated in the figures), which fluidically communicate with the suction-air bore 26 in the suction head 24.

As is illustrated in FIGS. 2 and 3, the movement of the suction head 24 in the direction of the circumferential surface of the upstream sheet-conveying cylinder 10 is limited by a stop in the form of an adjusting screw 40. The adjusting screw 40 is screwed into a threaded hole 38 in the leaf spring 22 and which, for example, can be constructed as a dowel pin having an internal hexagonal hole and which is secured in its position by a nut 42.

During the transfer, illustrated in FIGS. 2 and 3, of the sheet trailing edge 14, the holding arm 18 of the inventive suction gripper 6 pivots out of the periphery 8 of the downstream sheet-conveying cylinder or drum 4, until it reaches the position illustrated in FIGS. 2 and 3, which is always identical, irrespective of the printed material being processed. In the case of printed materials of minimum thickness, the adjusting screw 40 is preferably screwed into the threaded hole 38 in the leaf spring 22 to such an extent that the free end of the adjusting screw 40 rests just on the inside of the holding arm 18, and there is a small gap between the upper side of a sheet 16*a* and the suction face 36.

However, it is likewise conceivable to adjust the adjusting screw 40 in such a way that a small gap remains between the free end of the adjusting screw 40 and the inside of the holding arm 18, and the suction face 36 of the suction head 24 rests directly on the surface of the sheet 16a, even when processing sheets 16 of a minimum thickness.

In the case of processing thick sheets 16*b*, the leaf spring 22 is deflected further, counter to its prestress, on account of the distance, enlarged by the sheet thickness, between the suction face 36 and the circumferential surface of the upstream sheet-conveying cylinder 10, which is indicated by the very enlarged gap 44 in FIG. 3. As a consequence of the preferably great length and the prestress of the leaf spring 22, the suction head 24 is pressed with a well-defined contact force against the trailing edge 14 of the sheets when thick sheets 16*b* are being processed, the force being low, such that damage to the suction gripper 6 and to its drive, even over a relatively long period, is reliably avoided.

Figure 6A:
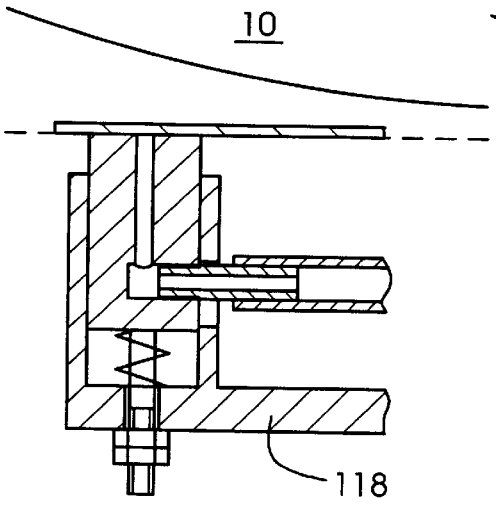
FIG. 6*a* is a fragmentary, sectional view of a location of the trailing edge of the thin sheet, as well as the suction head position of the suction gripper of FIG. 5*a* after being pivoted back into a sheet transfer position.
Figure 6B:
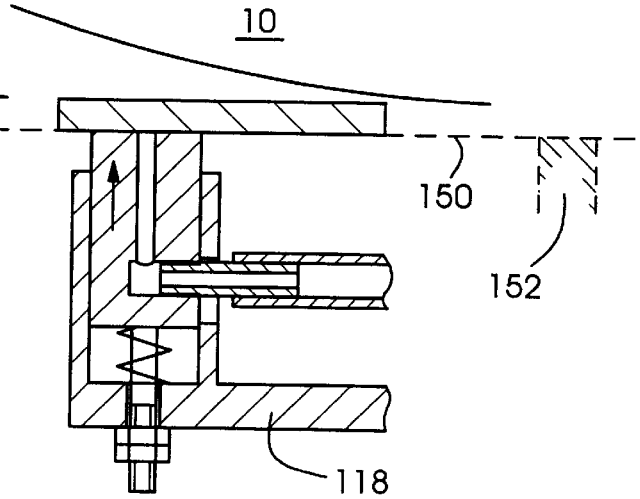
FIG. 6*b* is a fragmentary, sectional view of the location of the trailing edge of the thick sheet, as well as of the suction head position of the suction gripper of FIG. 5*b* after being pivoted back into the sheet transfer position.

After the trailing edge 14 of the sheets 16*a*, 16*b* to be processed has been gripped by the suction face 36 of the suction head 24, the holding arm 18 of the inventive suction gripper 6, before passing the gripper center line 12 (see FIG. 1), pivots back into the periphery 8 of the downstream sheet-conveying cylinder 4. Here, the free end of the adjusting screw 40 rests on the inside of the holding arm 18 because of the prestress of the leaf spring 22, as a result of which the suction face 36 of the suction head 24, and therefore the surface of the printed side of the sheet 16*a*, 16*b* that is picked up by the suction face 36 by suction, always assume the same, well-defined position, which is adjustable via the adjusting screw 40, during the transfer of the sheet trailing edge 14 to a downstream gripper, irrespective of whether thick or thin sheets are being processed. Furthermore, in order to increase the precision of transfer, provision may be made for lateral guides 46 to be formed on the holding arm 18, between which guides the leaf spring 22 is guided laterally when the suction head 24 is being deflected. The positioning and location of the printed sheet side 16*a*, 16*b* during the transfer of the trailing edge 14 of the sheet 16*a*, 16*b* will be described again in detail further below in connection with FIGS. 6*a* and 6*b*, using the embodiment shown in FIG. 4 of the suction gripper.

Figure 4:
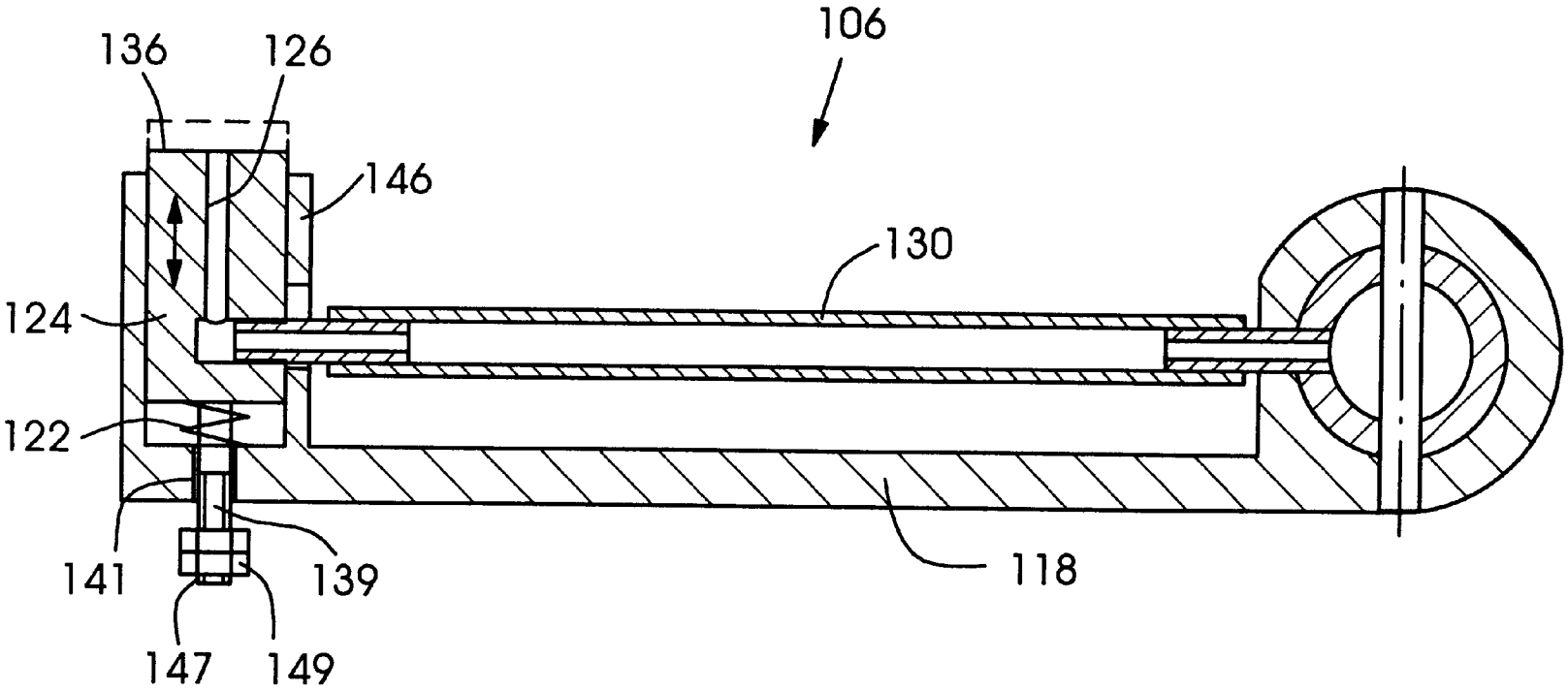
FIG. 4 is a sectional view of a second embodiment of the suction gripper, in which a suction head is accommodated displaceably in a guide formed on a holding arm of the suction gripper.
Figure 5A:
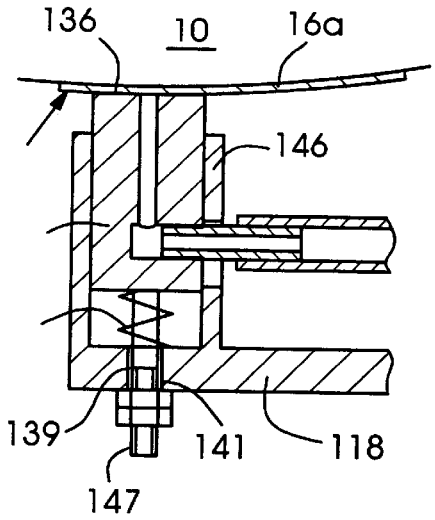
FIG. 5*a* is a fragmentary, sectional view of the suction gripper of FIG. 4 when gripping the thin sheet.
Figure 5B:
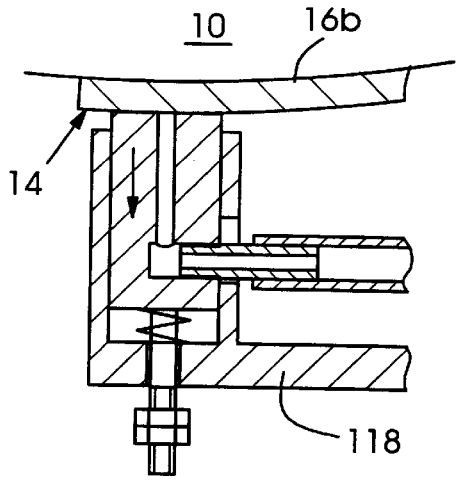
FIG. 5*b* is a fragmentary, sectional view of the suction gripper of FIG. 4 when gripping the thick sheet.

In the case of a second embodiment illustrated in FIG. 4, of an inventive suction gripper 106, in which the parts corresponding to the embodiment of FIGS. 2 and 3 are designated by a reference number increased by 100, a suction head 124 is accommodated in a guide 146 formed on a holding arm 118.

On that side of the suction head 124 which is located opposite a suction face 136 of the suction head 124, a pin element 139 springs out, extends through an opening 141 formed in the pivotable holding arm 118 and preferably has a threaded section 147, onto which one or more stop nuts or locking nuts 149 are screwed. Accommodated within a guide 146 in the suction head 124 is a compression spring 122, which is preferably disposed around the pin element 139 and which is supported by its one end on the holding arm 118 and by its other end on the suction head 124. The compression spring 122 forces the suction head 124 in the direction toward the circumferential surface of the upstream sheet-conveying cylinder 10. The pin element 139 preferably has, in the region of the compression spring 122, a smooth-walled outer surface, which ensures precise guiding of the compression spring 122. Instead of a compression spring 122, provision can also be made for appropriate springy device(s), for example a plurality of compression springs, an elastomer with additional damping properties or else a pneumatic element, such as an air bag, to be disposed between the suction head 124 and the holding arm 118 of the inventive suction gripper 106 of FIG. 4. The springy devices apply a spring force to the suction head 124. The compression spring 122 is preferably a spring with a small spring constant but which is comparatively strongly prestressed. The movement of the suction head 124 out of the guide 146 is limited by the nuts 149 and the pin element 139, which together form a stop for the suction head 124. The suction head's position in relation to the holding arm 118 can be adjusted with the aid of the nuts 149.

In the case of the embodiments of the invention shown in FIGS. 2 to 6, the suction head preferably has a cylindrical or rectangular shape.

The way in which the inventive suction gripper of FIG. 4 functions will be described below with reference to FIGS. 5*a*, 5*b* and 6*a*, 6*b*.

After the holding arm 118 has been pivoted out of the periphery 8 of the downstream sheet-conveying cylinder 4, the suction face 136 of the suction head 124 is pressed against the trailing edge 14 of the sheet 16*a*, 16*b*. The holding arm 118 of the suction gripper 106 always assumes the same position and, consequently, the suction head 124 is not moved, or is moved to a greater or lesser extent, into the guides 146, depending on the thickness of the sheet material being processed. This ensures that the suction face 136 of the suction head 124 does not rest with an excessively high force on the sheet 16*b* during the processing of thick to very thick sheets 16*b*, by which the suction gripper 6, 106 or the drive to the same is subjected to only slight loadings.

After the holding arm 118 has been pivoted back in the direction of the periphery 8 of the downstream sheet-conveying cylinder 4, the suction head 124 holding the sheet 16*a*, 16*b* is forced out of the guide 146 by the force of the compression spring 122, compare FIGS. 5*a* to 6*a*. The location of the suction head 124 and hence the location of the trailing edge 14 of the sheet 16*a*, 16*b* being predefined by the nuts 149. As emerges from FIGS. 6*a* and 6*b*, the location of the suction head 124 is adjusted with the aid of the nuts 149, preferably such that the surface of the printed side of the sheet 16*a*, 16*b* in the region of its trailing edge 14 runs on the transfer position 150 illustrated in FIGS. 6*a* and 6*b* as a dashed line. It being possible for this position to be predefined, for example by the upper side of the gripper pad 152 indicated schematically in FIG. 6*b*.

Figure 7:
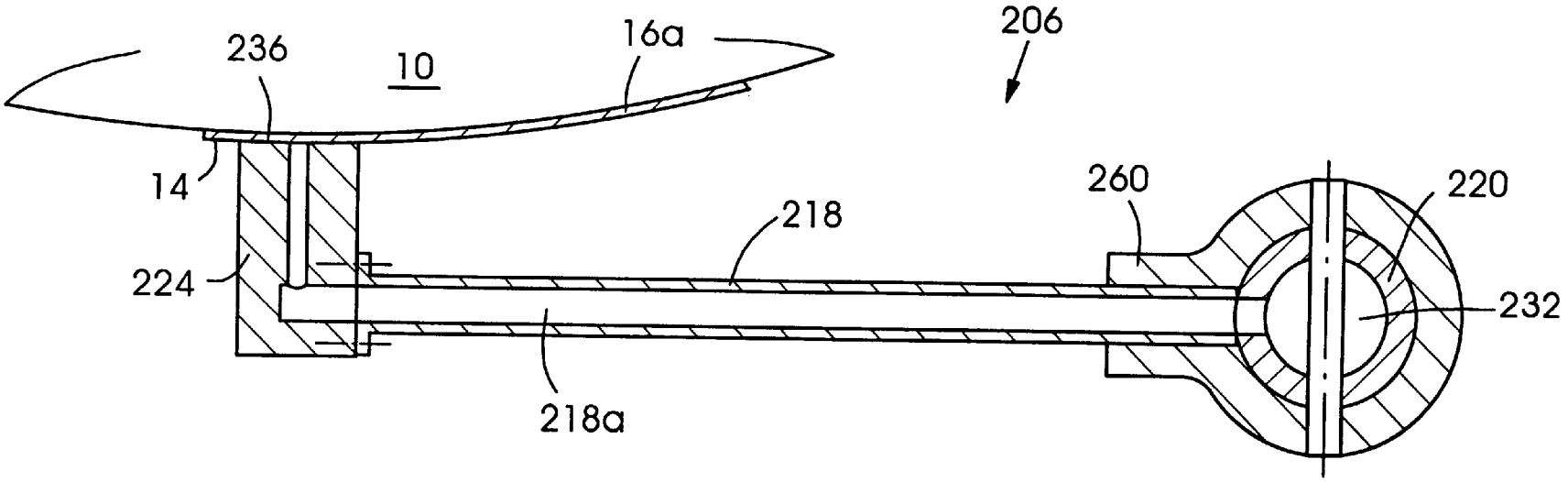
FIG. 7 is a sectional view of a third embodiment of the suction gripper, in which the holding arm is of flexible construction.

According to a third embodiment of the invention, shown in FIG. 7, the holding arm 218 carrying the suction head 224 of the suction gripper 206 is produced from an elastic material, without any stop or any limit for the holding arm 218. In the case of the third embodiment of the invention, the holding arm 218 is preferably produced from a thin-walled tube 218 of a flexible material, such as steel, titanium or aluminum, or else plastic, for example carbon fiber material.

As illustrated in FIG. 7, the first end of the inventive flexible tube 218 is accommodated in a sleeve 260 that is connected to a gripper shaft 220. The interior 218a of the tube 218 is advantageously constructed as a suction-air feed line to a suction head 224 and having a flow connection to a suction-air feed bore 232 in a gripper shaft 220. The other end of the flexible tube 218 is connected to the suction head 224, for example by screws or a sleeve, the suction head preferably having the same construction as the suction heads 24 and 124 of the embodiments previously described.

The wall diameter of the inventive tube 218 is selected as a function of the material used and of the length of the tube, in such a way that the suction head 224 on the one hand has sufficient strength that a free and uncontrolled movement of the same is reliably ruled out, in particular at high continuous printing speeds, and, when said suction head is pivoted in toward the trailing edge 14 of the sheet 16, a predefined distance between the suction face 236 of the suction head 224 and the sheet 16 or to the circumferential surface of the upstream sheet-conveying cylinder 10 is always established. On the other hand, even when processing sheets 16*b* of maximum thickness, only comparatively low forces act on the suction gripper 206 and its drive, these forces having no damaging effects.

As has been shown, the suction gripper 206, on account of its comparatively low weight of, for example, only 8–15 g and the associated low inertial forces, has such a high stiffness that precise positioning of the suction head 224 is ensured when it is pivoted in toward the upstream sheet-conveying cylinder, but, on the other hand, the forces acting on the suction gripper 206 and its drive when processing thick sheets 16*b* are considerably smaller than the forces which, over a relatively long period, lead to damage to the suction gripper 224 or its drive.

The holding arm 218 can, moreover, be constructed in such a way that its stiffness in the running or transport direction of the sheet 16, and also in a direction transverse to the sheet transport direction, is several times greater than in the pivoting direction of the same. This ensures that, in the case of additional stretching of the sheet 16 in the sheet longitudinal direction when the suction gripper 206 is being pivoted back into the periphery 8 of the downstream sheet-conveying cylinder 4, no lateral deviation of the holding arm 218 occurs, which can lead to inaccuracies when transferring the trailing edge 14 to a downstream gripper device.

Figure 8:
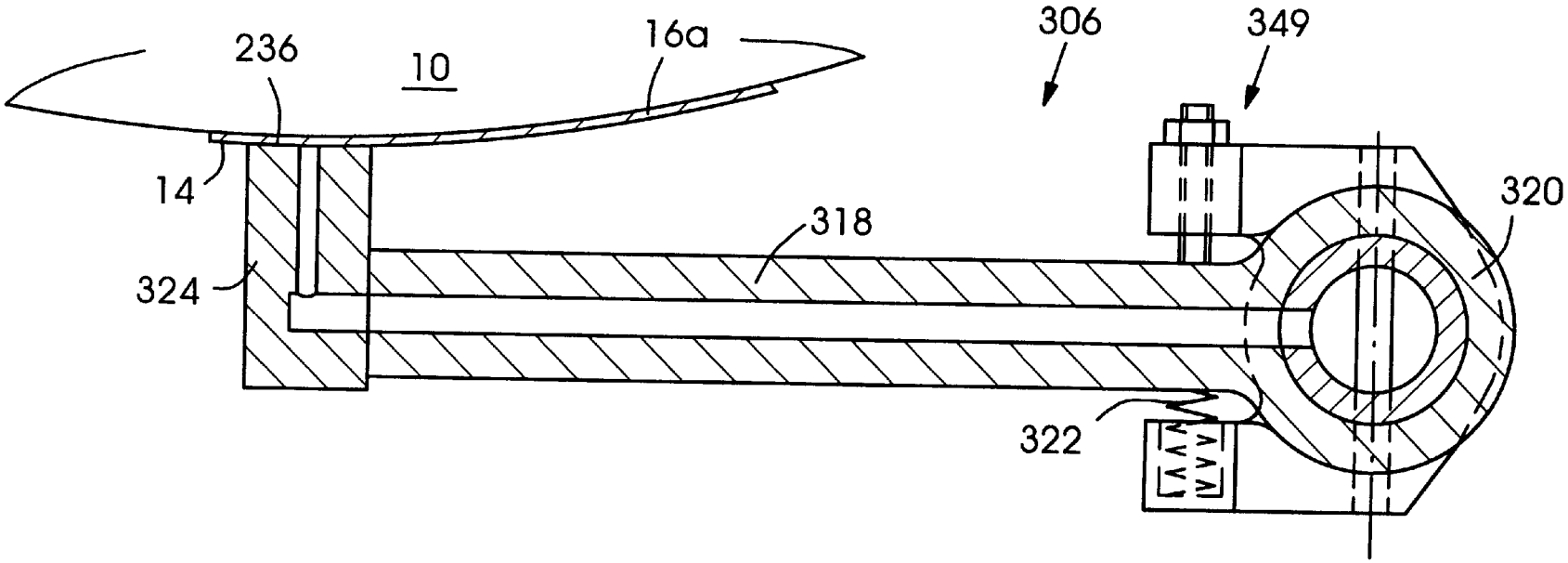
FIG. 8 is a sectional view of a fourth embodiment of the suction gripper, in which the holding arm is of stiff construction and is rotationally moveably connected to a gripper shaft via a spring.

According to a fourth embodiment, shown in FIG. 8, of an inventive suction gripper 306, a holding arm 318, together with a suction head 324 fastened to it, is constructed to be stiff overall and to be rotationally movably connected via springy devices 322 to the gripper shaft 320 actuating it. The movement of the stiff holding arm 318 in the direction of the trailing edge 14 of the sheet 16 to be turned is limited by a stop 349. The stop 349 preferably includes a stop that is rotationally fixedly connected to the gripper shaft 320 and against which the holding arm 318 is forced by the springy devices 322.

We claim:

1. In combination with a sheet-fed rotary printing machine having an upstream sheet-conveying cylinder with a circumferential surface and a turning device, a suction gripper for transferring a trailing edge of a sheet guided on the upstream sheet-conveying cylinder to the turning device having a downstream sheet-conveying cylinder with a circumferential surface, the suction gripper comprising:

a holding arm to be extended out of the circumferential surface of the downstream sheet-conveying cylinder;

a spring having two ends, a first of said two ends being supported by said holding arm;

a suction head movably connected to said holding arm via said spring, said suction head supported by a second of said two ends of said spring and said suction head being forced by said spring towards the circumferential surface of the upstream sheet-conveying cylinder; and a guide formed on said holding arm and accommodating said suction head, said suction head being accommodated in said guide.

2. The suction gripper according to claim 1, including a stop for limiting a movement of said suction head in a direction of a circumferential surface of the upstream sheet-conveying cylinder.

3. The suction gripper according to claim 2, wherein said spring is a leaf spring having a first end connected to said holding arm and a second end connected to said suction head.

4. The suction gripper according to claim 1, wherein said guide permits a movement of said suction head in a direction running substantially perpendicular to said holding arm.

5. The suction gripper according to claim 1, wherein said suction head has a central suction-air channel formed therein to be connected to a suction-air source.

6. The-suction gripper according to claim 5, wherein said suction head has a suction face with a large number of groove-like depressions formed therein for picking up the sheets and fluidically communicating with said central suction-air channel.

7. The suction gripper according to claim 1, wherein said suction head is selected from the group consisting of cylindrical shaped suctions heads and rectangular shaped suction heads.

8. In combination with a sheet-fed rotary printing machine having an upstream sheet-conveying cylinder and a turning device, a suction gripper for transferring a trailing edge of a sheet guided on the upstream sheet-conveying cylinder to the turning device having a downstream sheet-conveying cylinder with a circumferential surface, the suction gripper comprising:

a holding arm to be extended out of the circumferential surface of the downstream sheet-conveying cylinder;

a leaf spring having a first end connected to said holding arm and a second end;

a suction head movably connected to said holding arm via said second end of said spring; said leaf spring having a threaded hole formed therein; and a stop for limiting a movement of said suction head in a direction of a circumferential surface of the upstream sheet-conveying cylinder, said stop being supported on said holding arm and having an adjusting screw to be screwed into said threaded hole of said leaf spring.

9. In combination with a sheet-fed rotary printing machine having an upstream sheet-conveying cylinder and a turning device, a suction gripper for transferring a trailing edge of a sheet guided on the upstream sheet-conveying cylinder to the turning device having a downstream sheet-conveying cylinder with a circumferential surface, the suction gripper comprising:

a holding arm to be extended out of the circumferential surface of the downstream sheet-conveying cylinder, said holding arm having a guide formed thereon;

at least one compression spring accommodated in said guide and having a first end supported on said holding arm and a second end; and a suction head movably connected to said holding arm via said spring, said suction head supporting said second end and being accommodated in said guide, and said guide permitting a movement of said suction head in a direction running substantially perpendicular to said holding arm.

10. In combination with a sheet-fed rotary printing machine having an upstream sheet-conveying cylinder and a turning device, a suction gripper for transferring a trailing edge of a sheet guided on the upstream sheet-conveying cylinder to the turning device having a downstream sheet-conveying cylinder with a circumferential surface, the suction gripper comprising:

a holding arm to be extended out of the circumferential surface of the downstream sheet-conveying cylinder, said holding arm having an opening formed therein;

a spring;

a suction head movably connected to said holding arm via said spring; and a stop for limiting a movement of said suction head in a direction of a circumferential surface of the upstream sheet-conveying cylinder, said stop having a nut element and a pin element with a threaded section springing out of said suction head and said threaded section extending through said opening formed in said holding arm, and said nut element screwed onto said threaded section.

11. In combination with a sheet-fed rotary printing machine having an upstream sheet-conveying cylinder and a turning device, a suction gripper for transferring a trailing edge of a sheet guided on the upstream sheet-conveying cylinder to the turning device having a downstream sheet-conveying cylinder with a circumferential surface, the suction gripper comprising:

a gripper shaft;

a suction head for picking up the trailing edge of the sheet by suction; and a flexible holding arm to be extended out of the circumferential surface of the downstream sheet-conveying cylinder, said flexible holding arm having a first end connected to said gripper shaft and a second end connected to said suction head.

12. The suction gripper according to claim 11, wherein said holding arm has a greater stiffness in a sheet transport direction than in a direction towards a circumferential surface of the upstream sheet-conveying cylinder.

13. The suction gripper according to claim 11, wherein said holding arm has a greater stiffness in a direction transverse to a sheet transport direction than in a direction towards a circumferential surface of the upstream sheet-conveying cylinder.

14. The suction gripper according to claim 11, wherein said holding arm includes a flexible tube.

15. The suction gripper according to claim 11, wherein said suction head has a central suction-air channel formed therein to be connected to a suction-air source.

16. The suction gripper according to claim 15, wherein said suction head has a suction face with a large number of groove-like depressions formed therein for picking up the sheets and fluidically communicating with said central suction-air channel.

17. The suction gripper according to claim 11, wherein said suction head is selected from the group consisting of cylindrical shaped suctions heads and rectangular shaped suction heads.

18. In combination with a sheet-fed rotary printing machine having an upstream sheet-conveying cylinder with a circumferential surface and a turning device, a suction gripper for transferring a trailing edge of a sheet guided on the upstream sheet-conveying cylinder to the turning device having a downstream sheet-conveying cylinder with a circumferential surface, the suction gripper comprising:

a gripper shaft;

a spring;

a suction head for picking up the trailing edge of the sheet by suction;

a stiff holding arm to be extended out of the circumferential surface of the downstream sheet-conveying cylinder, said stiff holding arm having a first end rotationally movably connected to said gripper shaft via said spring and a second end carrying said suction head for picking up the trailing edge of the sheet by suction; and a stop limiting a movement of said stiff holding arm in a direction towards the circumferential surface of the upstream sheet-conveying cylinder;

said spring forcing said holding arm toward the circumferential surface of the upstream sheet-conveying cylinder against said stop.

19. The suction gripper according to claim 18, wherein said stop is formed on said gripper shaft.

20. The suction gripper according to claim 18, wherein said suction head has a central suction-air channel formed therein to be connected to a suction-air source.

21. The suction gripper according to claim 20, wherein said suction head has a suction face with a large number of groove-like depressions formed therein for picking up the sheets and fluidically communicating with said central suction-air channel.

22. The suction gripper according to claim 18, wherein said suction head is selected from the group consisting of cylindrical shaped suctions heads and rectangular shaped suction heads.

23. In combination with a sheet-fed rotary printing machine having an upstream sheet-conveying cylinder and a turning device, a suction gripper for transferring a trailing edge of a sheet guided on the upstream sheet-conveying cylinder to the turning device having a downstream sheet-conveying cylinder with a circumferential surface, the suction gripper comprising:

a holding arm to be extended out of the circumferential surface of the downstream sheet-conveying cylinder;

a spring;

a suction head movably connected to said holding arm via said spring; and a stop for limiting a movement of said suction head in a direction of a circumferential surface of the upstream sheet-conveying cylinder, said stop being adjustable.

24. In combination with a sheet-fed rotary printing machine having an upstream sheet-conveying cylinder with a circumferential surface and a turning device, a suction gripper for transferring a trailing edge of a sheet guided on the upstream sheet-conveying cylinder to the turning device having a downstream sheet-conveying cylinder with a circumferential surface, the suction gripper comprising:

a gripper shaft;

a spring;

a suction head for picking up the trailing edge of the sheet by suction;

a stiff holding arm to be extended out of the circumferential surface of the downstream sheet-conveying cylinder, said stiff holding arm having a first end rotationally movably connected to said gripper shaft via said spring and a second end carrying said suction head for picking up the trailing edge of the sheet by suction; and a stop limiting a movement of said stiff holding arm in a direction towards the circumferential surface of the upstream sheet-conveying cylinder, said stop being adjustable.

* * * * *